United States Patent [19]

Junkers

[11] Patent Number: 4,706,527

[45] Date of Patent: Nov. 17, 1987

[54] FLUID OPERATED WRENCH FOR TIGHTENING OR LOOSENING A THREADED CONNECTOR

[76] Inventor: John K. Junkers, 7 Arrowhead La., Saddle River, N.Y. 07458

[21] Appl. No.: 876,268

[22] Filed: Jun. 19, 1986

Related U.S. Application Data

[63] Continuation of Ser. No. 663,996, Oct. 22, 1984, abandoned.

[51] Int. Cl.[4] ..... B25B 13/46

[52] U.S. Cl. ..... 81/57.39

[58] Field of Search ..... 81/57.39, 57.3, 60

[56] References Cited

U.S. PATENT DOCUMENTS 2,961,904 11/1960 Sergan ..... 81/60

4,200,011 4/1980 Wilmeth ..... 81/57.39

*Primary Examiner*—Frederick R. Schmidt

*Assistant Examiner*—Debra S. Meislin

*Attorney, Agent, or Firm*—Michael J. Striker

[57] ABSTRACT

A fluid operated wrench for tightening or loosening a threaded connector without turning the wrench around comprises fluid operated cylinder and piston unit having an axis, a support including a first support portion for supporting the cylinder and piston structure, and a second support portion extending substantially perpendicularly to the axis of the cylinder and piston structure, ratchet held by the first support portion and having a ratchet axis extending substantially perpendicular to the latter, reversable transmission intermediate the cylinder and piston unit and the ratchet structure to drive the latter in one or the opposite direction during movement of the piston, structure connected to the ratchet structure for engaging a threaded connector to be turned, whereby during turning of the threaded connector in one direction a force is created tending to turn the support structure in the opposite direction, a reaction member arranged to abut against a stationary object, and structure for adjustably attaching the reaction member to the second support portion so that the reaction member is supported by the second support portion and can be adjusted to abut against a stationary object in any position within a circle of 360° around the ratchet axis, in any position within a circle of 360° around the ratchet axis, including turning the reaction member by 180° to abut against a stationary object located at either side of a threaded connector to be turned while the support structure remains stationary.

13 Claims, 4 Drawing Figures

FLUID OPERATED WRENCH FOR TIGHTENING OR LOOSENING A THREADED CONNECTOR

This is a continuation of application Ser. No. 663,996, filed Oct. 22, 1984, now abandoned.

BACKGROUND OF THE INVENTION

Various fluid-operated wrenches, including drive means in form of a cylinder and a piston reciprocating therein which drive over a ratchet arrangement a shaft to which a socket is connected for engaging a threaded connector to tighten or loosen the same, are known in the art. One drawback of these known construction is, that when the wrench has to be used for loosening instead of tightening a threaded connector, the whole wrench has to be turned around through 180° which makes for a cumbersome operation.

Since during driving of the ratchet and the socket connected thereto in one direction, a force is created tending to turn the whole wrench in the opposite direction, most of the fluid operated wrenches include also a reaction member, for instance adapted to abut against a threaded connector adjacent to the one to be turned, to counteract this force. If the threaded connector has to be turned in tightening direction, this reaction member has to abut against one side of the adjacent threaded connector and if the wrench is used for loosening a threaded connector the reaction member has to abut against the other side of the adjacent connector. But this is not possible in all cases, since sometimes if two flanged tube members have to be connected by the threaded connectors, the threaded connectors are so close to the outside surface of the tubes so that the reaction member cannot be placed between the adjacent threaded connector and the projecting tube.

Another drawback of known fluid operated wrenches is that the overall height of the wrench is rather large so that its application in certain constructions is extremely difficult and sometimes even impossible.

SUMMARY OF THE INVENTION

It is an object of the present invention to provide a fluid-operated wrench including a cylinder and a piston reciprocated therein as drive means, in which the overall height of the wrench is reduced to a minimum.

It is a further object of the present invention to provide a fluid-operated wrench of the aforementioned type, which can be used for tightening or loosening a threaded connector without turning the wrench around.

It is an additional object of the present invention to provide the wrench with an adjustable reaction member which can be used even at situations in which the reaction member cannot be placed between an adjacent threaded connector and the outer surface of a flanged tube.

With these and other objects in view, which will become apparent as the description proceeds, the fluid operated wrench for tightening or loosening a threaded connector without turning the wrench around mainly comprises support means including a drive support portion, a transmission support portion arranged symmetrically with respect to the drive support portion but extending angularly with respect thereto and a reaction support portion extending perpendicular from the transmission support portion, the support portions being operatively connected to each other; fluid operated cylinder and piston means mounted on said drive support portion extending substantially in the direction of the latter; ratchet means in the transmission support portion; reversable transmission means in said transmission support portion interconnected between said cylinder and piston means and said ratchet means to drive the latter in one or the opposite direction during movement of said piston means; means connected to said rachet means for engaging a threaded connector to be turned, whereby during turning of the threaded connector in one direction a force is created tending to turn said support means in the opposite direction; and a reaction member adjustably connected to said reaction support means to abut against a stationary object adjacent to either side of the threaded connector to be turned depending on the direction of turning of the threaded connector.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DESCRIPTION OF A PREFERRED EMBODIMENT

Figure 1:
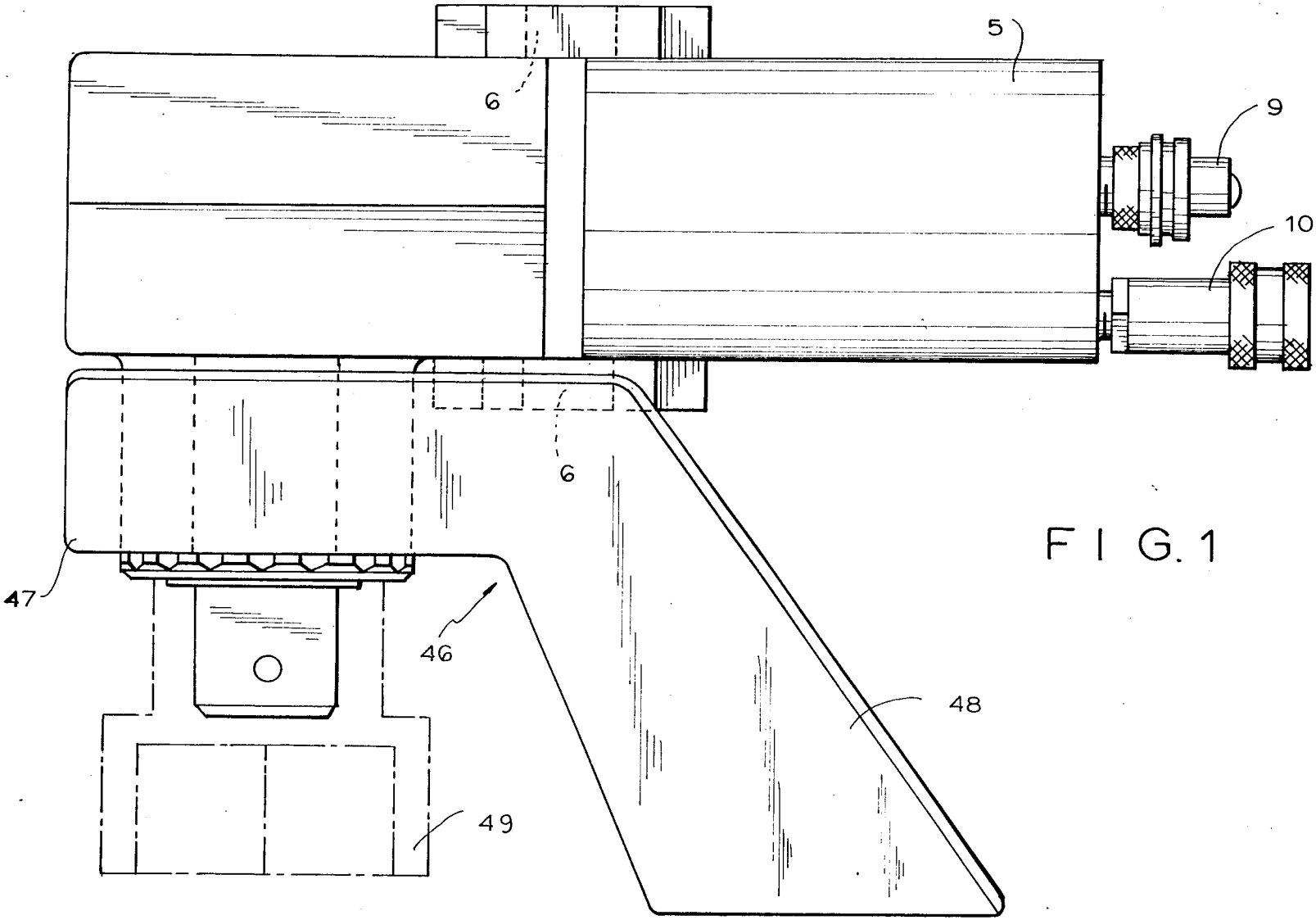
FIG. 1 is a side view of the wrench according to the present invention.
Figure 2:
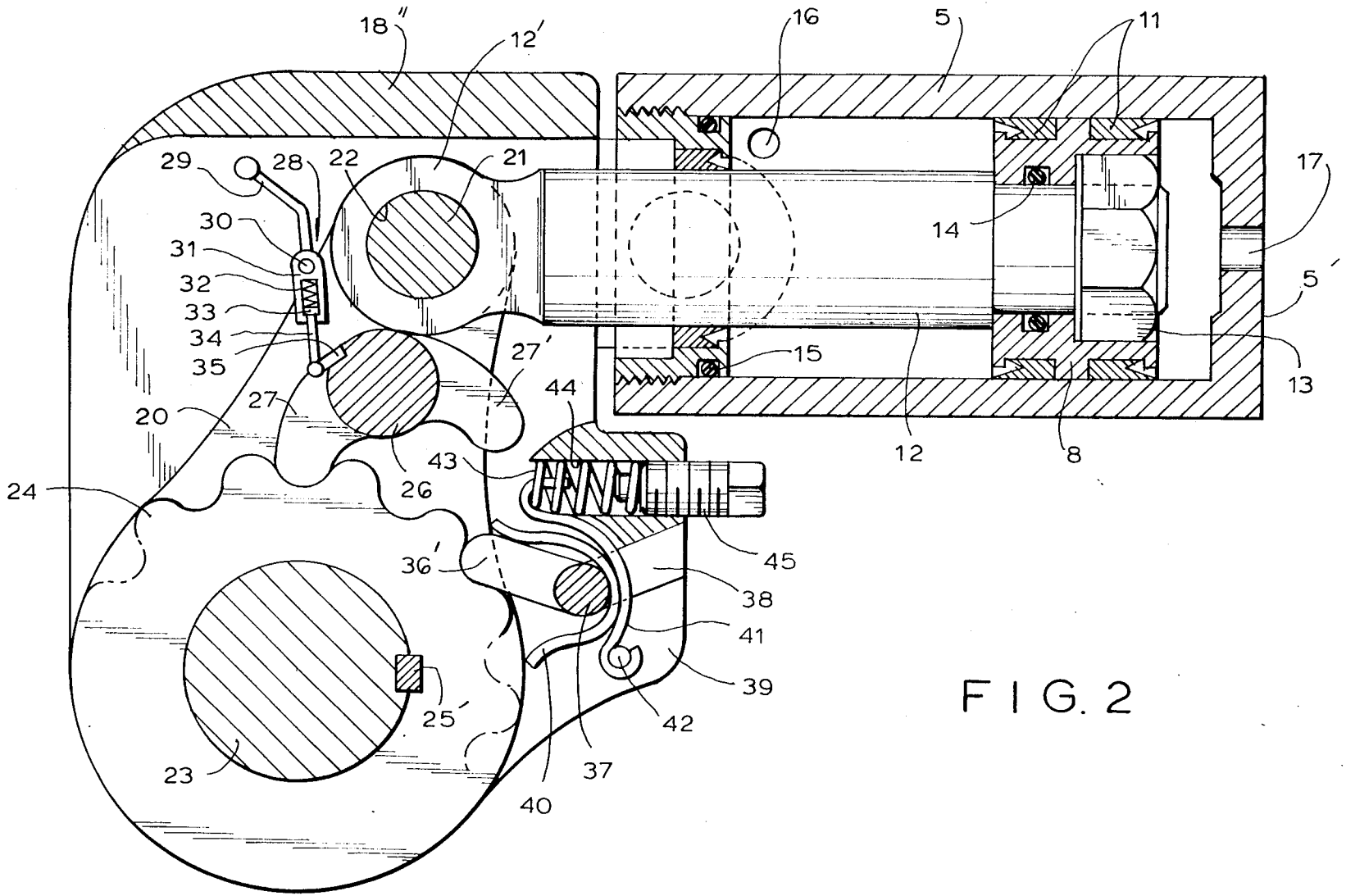
FIG. 2 is a section taken along line 2—2 of FIG. 4 through the wrench shown in FIG. 1.
Figure 3:
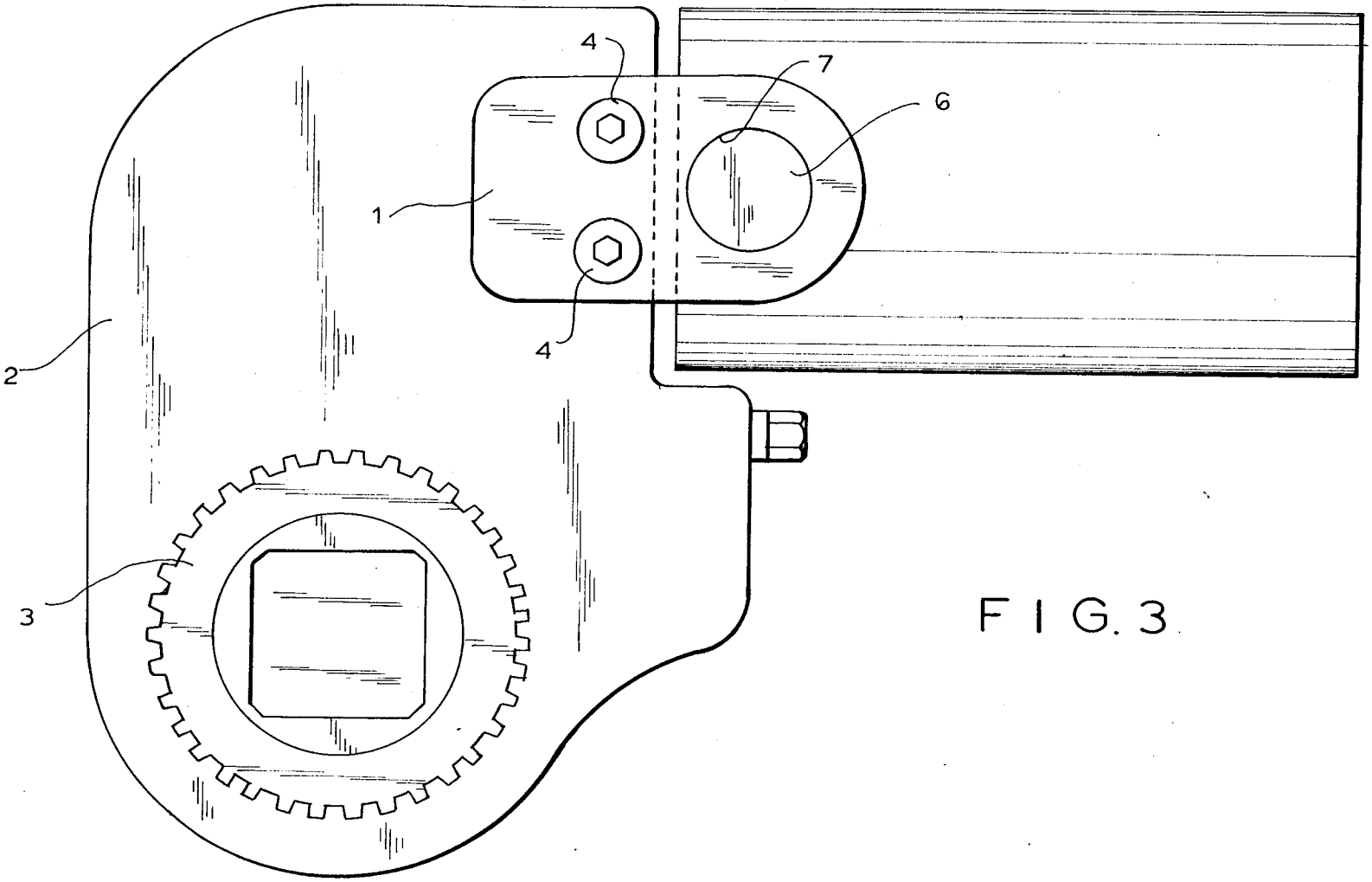
FIG. 3 is a bottom view of the wrench showing the reaction support portion, but the reaction member omitted therefrom

Referring now to the drawing, it will be seen that the wrench according to the present invention comprises support means including, as best shown in FIG. 3, a drive support portion 1, a transmission support portion 2 arranged symmetrically with respect to said drive support portion 1 but extending angularly with respect thereto, and a reaction support portion 3 extending perpendicular to one side from said transmission support portion, the support portions being operatively connected to each other, for instance the transmission support portion 2 may be connected by screws 4 to the drive support portion whereas the reaction support portion 3 may be integral with and projecting to one side of the transmission support portion 2. Fluid operated cylinder and piston means, best shown in FIG. 2, are mounted on said drive support portion extending substantially in the direction of the latter. These fluid operated cylinder and piston means include a cylinder 5 provided at the end thereof facing the drive support portion 1 with a pair of trunions 6 projecting to opposite sides of the cylinder and being pivotally engaged in appropriate bores 7 in the drive support portion 1. A piston 8 is reciprocatedly arranged in the cylinder 5 between a forward and a return stroke. Means 9 and 10 are connected to the outer end of the cylinder 5 for feeding pressure fluid in a known manner, not specifically shown in the drawing, to opposite sides of the piston 8 to reciprocate the latter along a forward and a return stroke. The piston 8 is provided in the usual manner with annular seals 11 properly sealing the outer surface of the piston against the inner surface of the cylinder 5. A piston rod 12 is connected, for instance by a nut 13, to the piston 8, but on the other hand, the piston rod 12 may also be integrally connected to the piston 8. If the piston rod is connected by the nut 13 as shown in FIG. 2, an additional annular seal 14 is provided around the portion of the piston rod 12 extending through the piston 8. A further annular seal 15 is of course provided at the end of the cylinder 5 facing the transmission support portion 2 and one of the fluid feeding means opens at 16 adjacent the end seal 15, whereas the other of the fluid feeding means passes through an opening 17 in the rear wall 5' of the cylinder 5.

Figure 4:
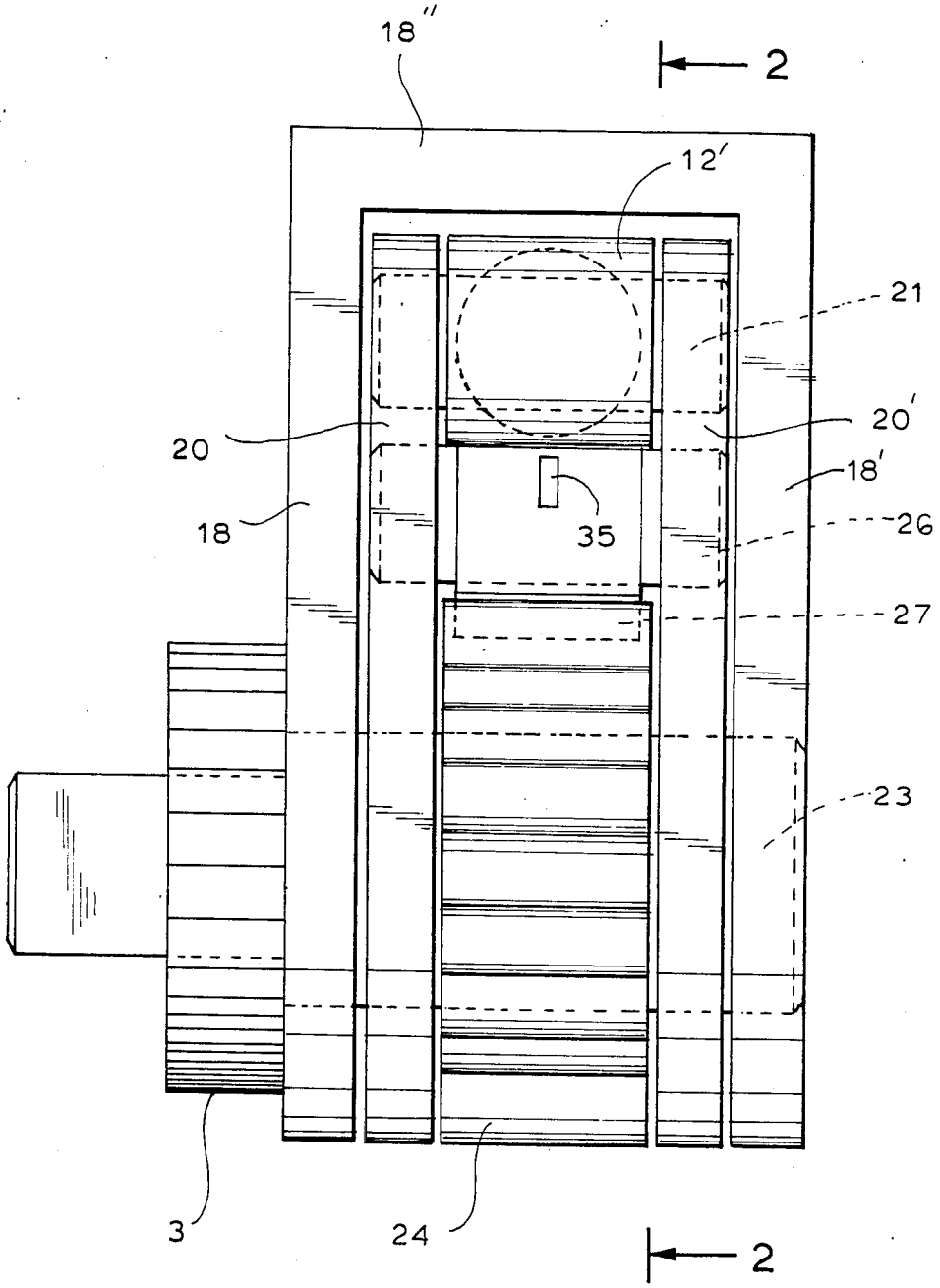
FIG. 4 is a front view of the wrench, with certain details omitted.

The transmission support portion 2 comprises two side walls 18, 18', best shown in FIG. 4, preferably integral with a top wall 18''. A pair of lever means 20 and 20', best shown in FIGS. 2 and 4 are arranged parallel and closely adjacent to the side walls 18 and 18' of the transmission support portion 2. These lever means 20 and 20' are pivotally connected to the outer end 12' of the piston rod 12 by a pin 21 extending through appropriate bores 22 in the lever means 20. The lever means 20, 20' are in the region of their lower ends freely pivotable on a shaft 23 which extends through appropriate bores in the lever means, as well as through bores in the side walls 18 and 18' and with an end portion thereof beyond one of the side walls, here shown as side wall 18. The outer end portion of the shaft 23 is perferably of square cross-section adapted to receive a standard socket 49 for engagement with the head of a threaded connector or a nut to be turned. A ratchet 24, best shown in FIG. 2 is fixed to the shaft 23 for rotation therewith by being for instance connected by key 25' thereto. A member 26 is pivotally mounted on the lever means 20 and 20' between the upper ends of the latter and the ratchet 24. Two curved pawls 27 and 27' integrally connected to the member 26 project to opposite sides thereof. A switching arrangement 28 is provided to bring a selected one of the two pawls in engagement with the teeth of the ratchet 24. This switching arrangement comprises a manually operated handle 29 pivoted by a pivot pin 30 on the lever means 20 and 20' and ending in a sleeve 31. A compression spring 32 is housed in the sleeve 31 acting on a plunger 33 guided in the sleeve 31 and extending into a pin 34. The pin 34 engages with its lower end in a groove 35 provided on the upper surface of the member 26 and the pawl 27. If the handle 29 is tilted about the pivot pin 30 in counterclockwise direction, so that the lower end of the pin 34 will engage the opposite end of the groove 35, it is obvious that the pawl 27 will be lifted out of engagement with the teeth of the ratchet 24, while the pawl 27' will be brought into engagement. In this way, the wrench can be used in a very simple manner for tightening or loosening a threaded connector without turning the wrench around.

The lever means, 20, 20' together with the member 26 and the pawls 27, 27' form transmission means transmitting a drive from the piston 12 to the ratchet 24.

The wrench includes further a holding pawl 36 engaging the teeth of the ratchet 24 and pivoted at the lower end thereof by trunions 37 respectively projecting to opposite sides into grooves 38 provided in a boss 39 projecting to one side of the transmission support portion 2 between the side walls 18 and 18' thereof. A first leaf spring 40 extending around the lower end of the holding pawl 36 and abutting with opposite ends against the lever means 20 and 20' holds the holding pawl in engagement with the teeth of the ratchet 24. A second leaf spring 41 extending about the outer surface of the first spring 40 is anchored at one end on a pin 42 extending between the side plates 18 and 18', whereas the other end of the second spring 41 engages into a coil spring 43 housed in a bore 44 and compressed by a screw 45 in this bore.

If the ratchet 24 is to be driven by the pawl 27', the holding pawl 36 has of course to be reversed to extend in the downward direction. This can be accomplished by loosening the screw 45 and turning the ratchet 24 in the appropriate direction, so that the pinions 37 at the end of the holding pawl 36 will slide upwardly in the groove 38 and the holding pawl will then extend in downward direction, thereafter the screw 45 is again tightened to bring the free end of the holding pawl 36 in proper engagement with the teeth of the ratchet 24.

As mentioned before, the switching arrangement 28 can bring either the pawl 27 or the pawl 27' in engagement with the teeth of the ratchet 24 so that during the reciprocation of the piston 8 in the cylinder 5 a nut or the like engaged in a socket connected to the outer square end of the shaft 23 may be turned either in tightening or loosening direction. Since a nut to be loosened may be corroded and require for loosening the same a greater force than for proper tightening of the same, the wrench is constructed in such a manner that during engagement of the pawl 27 with the teeth of the ratchet 24, that is when the ratchet is turned in loosening direction, the pressure fluid will act through the opening 17 in the end wall 5' of the cylinder on the full face of the piston 8 that is during the forward stroke of the piston in the cylinder, whereas if the pawl 27' is engaged with the ratchet teeth, the pressure fluid will act on the piston through the opening 16 on the annular face of the piston 8 reduced by the cross-section of the piston rod while the piston moves in rearward direction.

Since during turning of a threaded connector in one direction a reaction force is created tending to turn the support means in the opposite direction, the wrench of the present invention includes also a reaction member to abut against a stationary object adjacent to the threaded connector to be turned. If the threaded connectors are used to connect to flanged tube members this reaction member may abut against the outer surface of one of the flanges. Since the wrench of the present invention may be used for tightening or loosening a threaded connector without turning the wrench around, the reaction member has to be adjustable, since the aforementioned reaction force will tend to turn the support means in the one or the other direction. For this purpose a splined reaction support portion 3 projects normal and to the outside of the side wall 18 of the transmission support portion 2 coaxial with the shaft 23, which in turn extends through and beyond an opening in this reaction support portion. The reaction member 46 comprises a first splined annular portion 47 engaging with the splines of the reaction support portion 3 and a second portion 48 integral with the first portion and extending laterally from the latter substantially in the direction of the axis of the ratchet 24, to abut for instance on the outer surface of the flange in which the threaded connectors are provided. The reaction member 46 is thus adjustable to any desired position depending on the direction the reaction force will act.

The wrench of the present invention is characterized by a simple and sturdy construction of relatively small overall height. Its drive means are cylinder and piston means which are simpler in construction than rotary drive means and which require no gears for transmitting the drive from a rotary drive means to the socket to be engaged with the threaded connector to be turned. Nevertheless, the wrench of the present invention is provided with a simple switching arrangement which permits the use of the wrench in tightening or loosening a threaded connector without turning the wrench around. In conjunction with this feature, the wrench includes also an adjustable reaction member which can be easily brought into proper position depending whether the wrench is used for tightening or loosening a connector.

It will be understood that each of the elements described above, or two or more together, may also find a useful application in other types of fluid operated wrenches differing from the types described above.

While the invention has been illustrated and described as embodied in a fluid operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of this invention.

What is claimed as new and desired to be protected by Letters Patent is set forth in the appended claims.

I claim:

1. A fluid operated wrench for tightening or loosening a threaded connector without turning the wrench around, comprising fluid operated cylinder and piston means having an axis; support means including a first support portion for supporting said cylinder and piston means, and a second support portion for supporting a reaction member and extending substantially perpendicularly to said axis of said cylinder and piston means; ratchet means held by said first support portion and having a ratchet axis extending substantially perpendicular to the latter; reversable transmission means intermediate said cylinder and piston means and said ratchet means to drive the latter in one or the opposite direction during movement of said piston means; means connected to said ratchet means for engaging a threaded connector to be turned, whereby during turning of the threaded connector in one direction a force is created tending to turn said support means in the opposite direction; said reaction member arranged to abut against a stationary object; and means for adjustably attaching said reaction member to said second support portion, said attaching means includes incremental positioning means extending 360° about the ratchet axis so that said reaction member is supported by said second support portion and can be incrementally adjusted to abut against a stationary object in incremental positions along an arc of 360° around said ratchet axis, including turning said reaction member by 180° to abut against a stationary object located at either side of a threaded connector to be turned while said support means remains stationary.

2. A fluid operated wrench as defined in claim 1, wherein said first support portion includes a drive support section, said cylinder and piston means comprising a cylinder connected to said drive support section, a piston reciprocable in said cylinder between a forward and a return stroke, and a piston rod connected at one end to said piston and projecting with its other end beyond one end of said cylinder.

3. A fluid operated wrench as defined in claim 2, wherein said piston rod is fixedly attached at said one end to said piston and wherein said cylinder is pivotally connected to said drive support portion.

4. A fluid operated wrench as defined in claim 1, wherein said reversible transmission means comprise lever means connected at one end to said cylinder and piston means and mounted on the other end for pivotal movement in one and the opposite direction about the axis of said ratchet means and adjustable pawl means mounted on said lever means intermediate the ends of the latter and constructed to drive said ratchet means in one or in the opposite direction during pivotal movement of the lever means in one of the directions of the latter.

5. A fluid operated wrench as defined in claim 4 wherein said adjustable pawl means comprises a member mounted between opposite ends on said lever means tiltable about an axis parallel to the axis of said ratchet means, and a pair of pawls fixed to said member and projecting to opposite sides of the latter, and including manually operated switching means for bringing one or the other of said opposite pawls in engagement with the teeth of said ratchet means.

6. A fluid operated wrench as defined in claim 5, wherein said first support portion includes a transmission support section for supporting said transmission means, said transmission means including holding pawl means mounted in said transmission support section for preventing turning of the ratchet means in a direction opposite to that at which it is driven by said adjustable pawl means, said holding pawl means permitting turning of the ratchet means when the drive of said ratchet means by said adjustable pawl means is changed from said one to the opposite direction and vice versa.

7. A fluid operated wrench as defined in claim 1, wherein said second support portion is coaxial with the axis of said ratchet means.

8. A fluid operated wrench as defined in claim 7, wherein said reaction member comprises a first portion embracing said second support portion and a second portion integral with said first portion and extending laterally from the latter substantially in the direction of the axis of said ratchet means.

9. A fluid operated wrench as defined in claim 8, wherein said second support portion is in the form of a splined member integral with said transmission support section and said first portion of said reaction member has splines cooperating with said splined second support portion and together forming said attaching means.

10. A fluid operated wrench as defined in claim 1, and including a holding pawl mounted in said first support section portion for preventing said ratchet means to turn in a direction opposite to that which it is driven by said cylinder and piston means.

11. A fluid operated wrench as defined in claim 10, and including mounting means for said holding pawl in said transmission support section and spring means loading the holding pawl in such a manner so that said holding pawl will prevent said ratchet means to turn in a direction opposite to that which it is driven by said piston means regardless whether said piston means drives said ratchet means in one or the opposite direction.

12. A fluid operated wrench as defined in claim 1, wherein said cylinder and piston means comprises a cylinder, a piston reciprocatable in said cylinder, and a piston rod connected at one end to said piston and connected at the other end to said reversible transmission means; and means for alternatingly feeding, respectively discharging pressure fluid to and from opposite ends of said piston to reciprocate the latter along a forward and a return stroke, whereby the pressure fluid impinges during the forward stroke on one side of said piston on the full area of the latter, whereas the fluid impinging during the return stroke of said piston on the side of the latter to which said one end of said piston rod is connected on an annular piston face having a smaller area than said one side thereof, said reversible drive means being arranged so that when a threaded connector is to be turned in loosening direction, the pressure fluid will act during the forward stroke of said piston on said full piston face to thereby turn the ratchet means, whereas when said reversible drive means has to turn said threaded connector in tightening direction, the pressure fluid will act during the return stroke of said piston on said annular piston face to thereby turn the ratchet means.

13. A fluid operated wrench as defined in claim 1, wherein said reversible transmission means is formed as manually reversible transmission means; and further comprising manual switching means arranged to switch manually said manually reversible transmission means so that when a user manually acts on said switching means and thereby switches said reversible transmission means to one position, said reversible transmission means drive said ratchet means in said one direction during movement of said piston, while when a user manually acts on said switching means and thereby switches said reversible transmission means to another position, said reversible transmission means drive said ratchet means in an opposite direction during the movement of said piston.

* * * * *